US006886775B2

(12) United States Patent
Johnsson et al.

(10) Patent No.: US 6,886,775 B2
(45) Date of Patent: May 3, 2005

(54) FIN-STABILIZED SHELL

(75) Inventors: Stig Johnsson, Karlskoga (SE); Ulf Hellman, Ornskoldsvik (SE); Ulf Holmqvist, Karlskoga (SE)

(73) Assignee: Bofors Defence AB, Karlskoga (SE)

( * ) Notice: Subject to any disclaimer, the term of this patent is extended or adjusted under 35 U.S.C. 154(b) by 0 days.

(21) Appl. No.: 10/312,667

(22) PCT Filed: Jun. 13, 2001

(86) PCT No.: PCT/SE01/01332

§ 371 (c)(1),
(2), (4) Date: Jul. 14, 2003

(87) PCT Pub. No.: WO02/06760

PCT Pub. Date: Jan. 24, 2002

(65) Prior Publication Data

US 2004/0011919 A1 Jan. 22, 2004

(30) Foreign Application Priority Data

Jul. 3, 2000 (SE) ..... 0002487

(51) Int. Cl.[7] ..... F42B 10/14

(52) U.S. Cl. ..... 244/3.27; 244/3.3; 244/3.29; 102/385

(58) Field of Search ..... 244/3.23, 3.24, 244/3.25, 3.26, 3.27, 3.28, 3.29, 3.3; 102/384, 385

(56) References Cited

U.S. PATENT DOCUMENTS 3,819,132 A * 6/1974 Rusbach ..... 244/3.28
3,861,627 A * 1/1975 Schoffl ..... 244/3.27
4,944,226 A * 7/1990 Wedertz et al. ..... 102/476
H905 H * 4/1991 Rottenberg ..... 244/3.28
6,126,109 A * 10/2000 Barson et al. ..... 244/3.28
6,454,205 B2 * 9/2002 Niemeyer et al. ..... 244/3.26
6,571,715 B1 * 6/2003 Bennett et al. ..... 102/439

FOREIGN PATENT DOCUMENTS

DE 3344402 A1 6/1985
EP 0076990 A2 4/1983
GB 2265443 A 9/1993

* cited by examiner

*Primary Examiner*—Michael J. Carone
*Assistant Examiner*—Gabriel S. Sukman
(74) *Attorney, Agent, or Firm*—Connolly Bove Lodge & Hutz LLP; Larry J. Hume

(57) ABSTRACT

The present invention relates to a fin-stabilized artillery shell (1) comprising a body part (8, 26, 36) which can be axially displaced rearwards, in the direction of flight of the shell, once the latter has left the barrel from which it has been fired, and which in the original position is fully retracted in the shell (1), and in which a number of deployable fins (18, 24, 29–30, 42–47) are in turn secured, and from which the fins are automatically deployed as soon as the body part has reached its rear position in which it is locked relative to the rest of the shell. One of the advantages of the invention is that in the flight position it gives the shell a greater length than is permitted by the charging position of the artillery piece launching the shell. This gives the shell considerably better stability in its trajectory towards the target. The invention also includes different embodiments of the body part (8, 26, 36) which can be tubular (8) or cylinder-shaped (26) and accommodate different types of fins (18–24, 29–30, 42–47) and also in certain configurations a built-in base-bleed unit (3). The body part can also be divided into two parts (27, 34 and 37, 38) which rotate freely relative to each other and which allow the fins (18–24, 29–30, 42–47) to spin freely relative to the rest of the shell (1) which has been shown to make the latter more easily manoeuvred without impairing its directional stability.

17 Claims, 7 Drawing Sheets

FIN-STABILIZED SHELL

Figure 1:
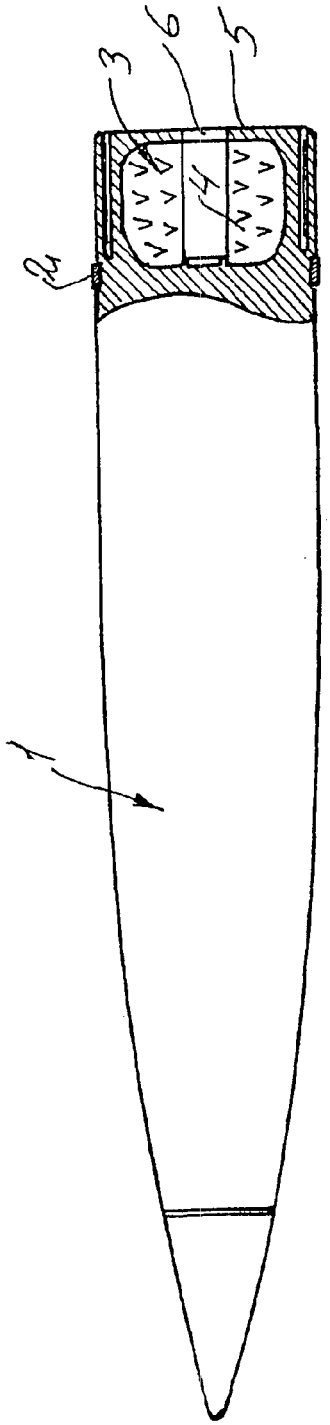

The present invention relates to a novel type of fin-stabilized artillery shell of the general type which is provided with a drive band as its direct contact with the inside of the barrel from which it is fired and which is therefore fired only at a low speed of rotation about its longitudinal axis and which, in order to stabilize it in its continued trajectory towards the target, is provided with stabilizing fins which are arranged at its rear end, are retracted initially and until the shell has completely left the barrel, and can then be deployed when the shell has fully left the barrel.

Fin-stabilized shells are mechanically more complicated than conventional rotation-stabilized shells, but they can be given longer ranges of fire since the fins included in them can be designed to give the shell an increased lifting force. It is also much easier to correct the flight path of a fin-stabilized nonrotating or slowly rotating shell than it is for corresponding rotation-stabilized shells rotating at high speed. These two properties have meant that development work on new long-range shells guided in their final phase has increasingly concentrated on making them fin-stabilized.

However, one problem which has had to be dealt with in connection with shells of this type is that the flight of the fin-stabilized shell in its trajectory towards the target is all the more stable, the further the fins are situated behind its centre of gravity in the direction of flight of the shell. In addition, the fins in the retracted position block a not inconsiderable space in the rear part of the shell, a space which it would often be desirable to use for some other purpose. The need to have the fins lying as far back as possible behind the centre of gravity of the shell additionally often conflicts with the maximum dimensions which are stipulated for artillery shells of different calibres and which must be complied with since they cannot otherwise be loaded into conventional artillery weaponry, which as a rule is an absolute requirement.

The present invention now relates to a novel type of fin-stabilized artillery shell of the abovementioned general type, that is to say one which is provided with a drive band and is thus intended to be fired at low rotation about its longitudinal axis, and which is additionally provided with stabilizing fins which are retracted in its rear end until it has completely left the muzzle of the barrel and which are designed in such a way that they are automatically deployed as soon as the shell is free of the barrel and the muzzle brake. According to the basic concept of the invention, the whole fin system is now designed in such a way that the fins are not only deployed when the shell has left the barrel: before they are deployed, they are additionally displaced to a new position which is situated behind the original rear plane of the shell during launch and where they are deployed. According to the basic concept of the invention, we thus obtain an extension of the distance to the centre of gravity of the shell and therefore a more stable flight for the shell.

All the developments of the invention which are defined in the attached patent claims are based on the fact that the fins, arranged about axles provided for this purpose, are to be mounted and initially retracted in a body part which is axially displaceable in the longitudinal direction of the shell relative to the rest of the shell body and which, until the shell has left the launch barrel, and with the fins retracted in the body part, occupies a space provided for this purpose in the rear part of the shell, and which, when the shell has left the barrel, is axially displaced to a second outer position in which it is locked relative to the rest of the shell and in which at least that part of the body comprising the fins and their bearing axles is located, in the direction of flight of the shell, behind the latter's original rear plane in a position which allows the fins to be deployed.

The fin-stabilizing unit included in the shell according to the invention can thus be said to be characterized primarily by the fact that the attachment points of the fins are formed by an axially displaceable body part which, from a first retracted position completely in front of the normal rear plane of the shell, can be pushed out to a second deployed position where the fins and their attachment points are situated behind the same rear plane and where the fins are free to unfold.

The body part in question can then have the basic shape of a tube along whose outer periphery the fins are secured and in the original position incurved towards the inside in an outwardly open annular track in the same and in the original position retracted into a tubular slit in the rear part of the shell. In the deployed position, this type of body part thus gives the shell a hollow base, which can be very advantageous, especially if the space in the actual shell body inside of the abovementioned slit contains a base-bleed unit.

If the body part instead has the shape of a cylinder which in the original position is inserted in a cylindrical cavity in the rear part of the shell and the fins are arranged along its outer periphery, then the base-bleed unit can be arranged inside the cylinder.

In these two variants of the invention, the fins are expediently of the type which are mounted deployably around axles arranged in the longitudinal direction of the shell, or corresponding components with a hinge function, and in the retracted position are incurved transversely and wrapped around the body in which the axles are secured, i.e. in this context the respective body part in each variant, and it is the inside of that part of the shell body in which the body part is arranged in the retracted position which, as long as the body part is located in its retracted position, also holds the fins incurved against the periphery of the respective body part, and the fins in the deployed and extended position, at least nearest their bearing axles, extend essentially radially out from the body part.

The fins in question here are therefore of the general type usually referred to as folding fins or wrap-around fins since, in the retracted position, they are folded in towards and wrapped around that part of the shell adjoining the retracted position of the fins, while in the deployed and extended position they extend essentially radially out from the shell body, at least nearest their bearing axles. In most of the older types of folding fins and wrap-around fins, especially those included in the missiles in the older reaction weapons and rocket weapons, these fins retain a large part of their curved shape even after deployment, but nowadays there are various light metals, steel and titanium materials available with such good inherent resilience and such good shape-memory that it is possible to produce fins which, despite being stored for many years in a curved retracted position, change directly to their original plane shape after deployment and thus come to extend completely radially outwards from the missile on which they are secured.

Since the previously mentioned annular gap or the space between the cylindrical body part, containing the base-bleed unit, and the inside of the shell opens out in the rear plane of the shell, the space between these and the inside of the shell is acted upon, during launching of the shell, by the whole of the gas pressure from the propellant powder charge used unless the space is extremely well sealed. A way of eliminating the risk of the gas pressure opening the seal between the mutually movable parts and deforming the fins is for all the space inside the gap not occupied by the holder part, the axles or the fins, to be filled with a noncombustible, nonsolidifying gel or the like with low decompressibility and low inherent strength. For example, certain silicones can be used for this purpose. As soon as the holder part has been pushed out and the fins have deployed, this gel material is thrown off from the shell and for this reason does not cause any further problems.

Other fins which can be used in connection with a variant of the invention are of the type which can be deployed about axles arranged transverse to the direction of flight of the shell and which, in the retracted position, are folded forwards and downwards in longitudinal radial tracks in the body part and which, upon deployment, execute a rotation, of at least 90°, outwards and rearwards about said axles. This type of fin has the advantage that the fins can be made long and, because they are angled rearwards in the deployed position, they can be given a further stabilizing effect. They are also easy to deploy since the relative wind catches the fins at an early stage of deployment and acts on them in the direction of deployment, and at the same time they are not affected by any substantial transverse forces which during the actual deployment phase could affect them in a negative direction.

According to a further variant of the invention, the respective body part can be divided up into at least two sections which rotate freely relative to each other, of which one body section ensures the connection with the rest of the shell when the body part is in the deployed position, while the second body section, at the rear in the direction of flight of the shell, supports the fins. This variant affords a shell with a free-spinning tail and fin portion, which can be very advantageous since it gives the shell much better manoeuvrability (it is quite simply easier to manoeuvre and thus requires less rudder angle, for example on controllable fins, for a defined manoeuvre) without thereby losing its directional stability.

Figure 2:
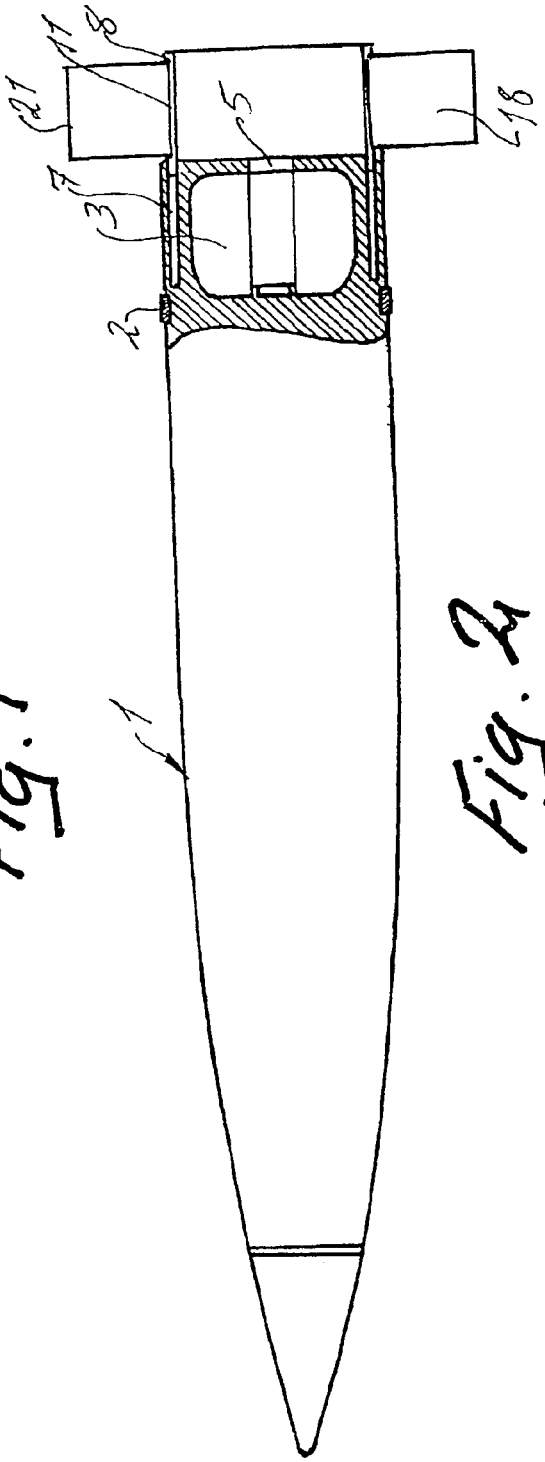
Figure 4:
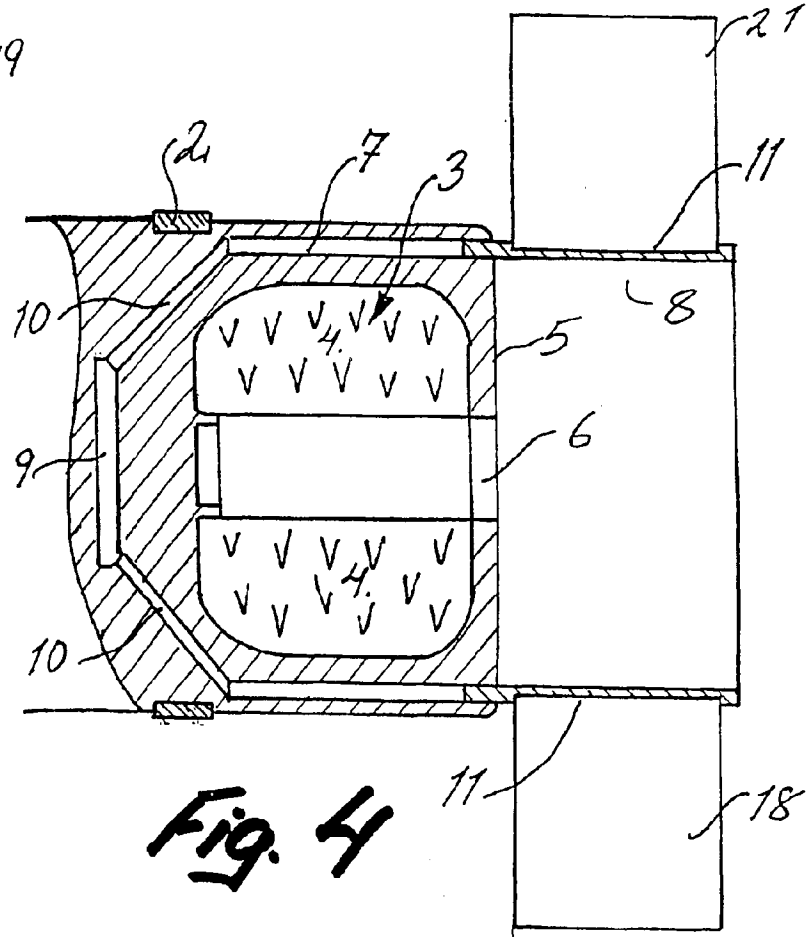
Figure 3:
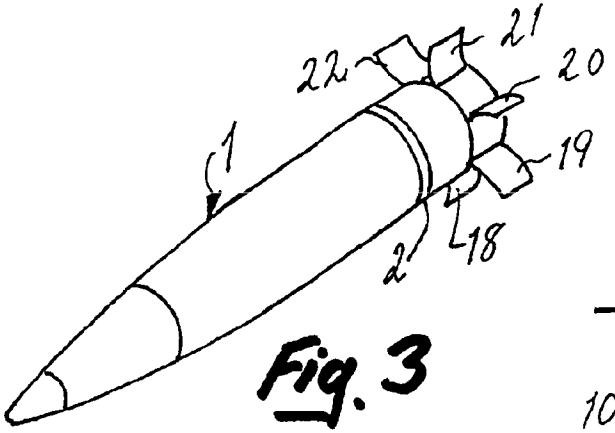
Figure 5:
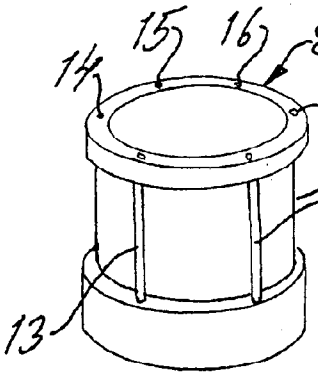
Figure 6:
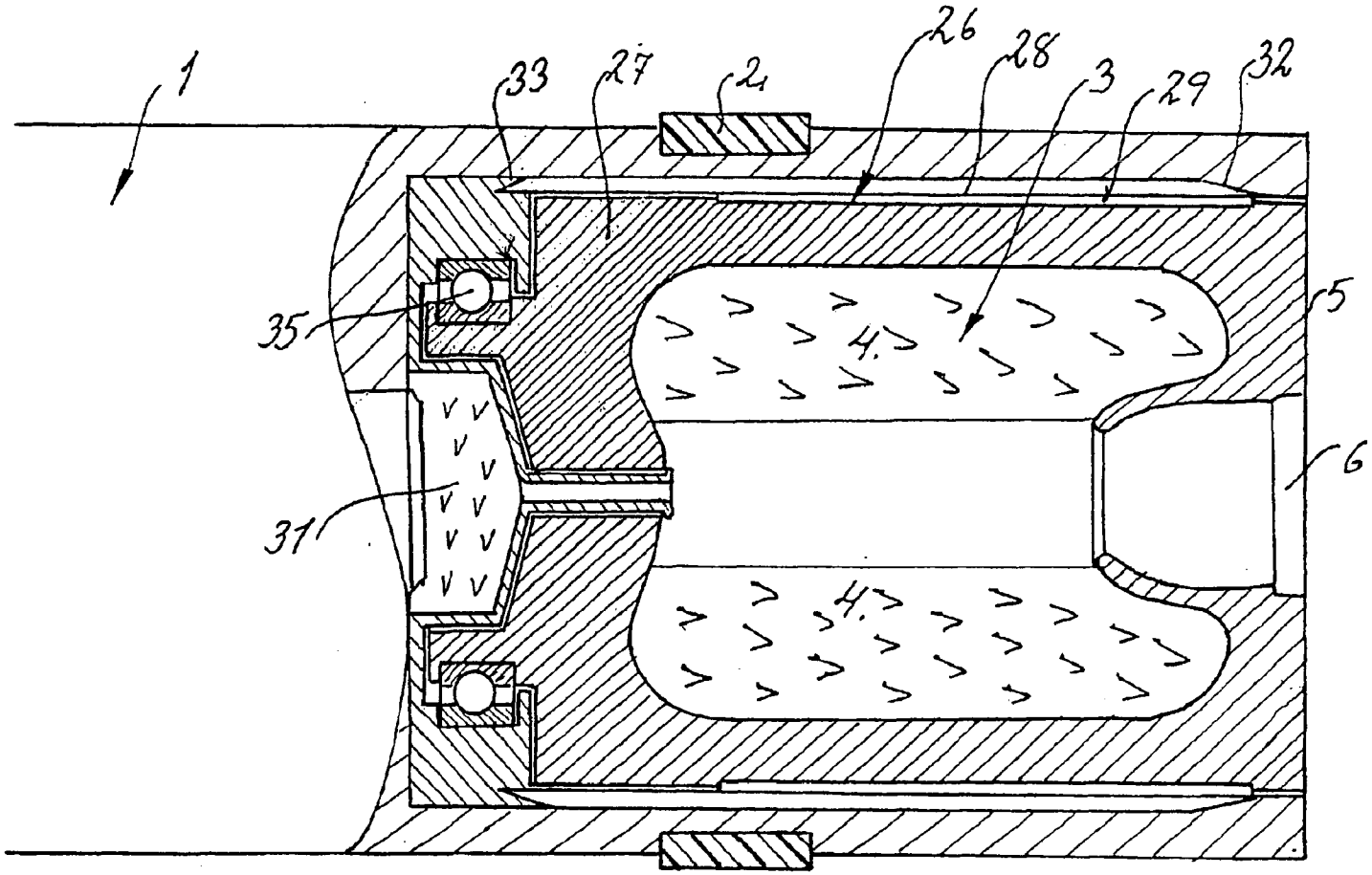
Figure 7:
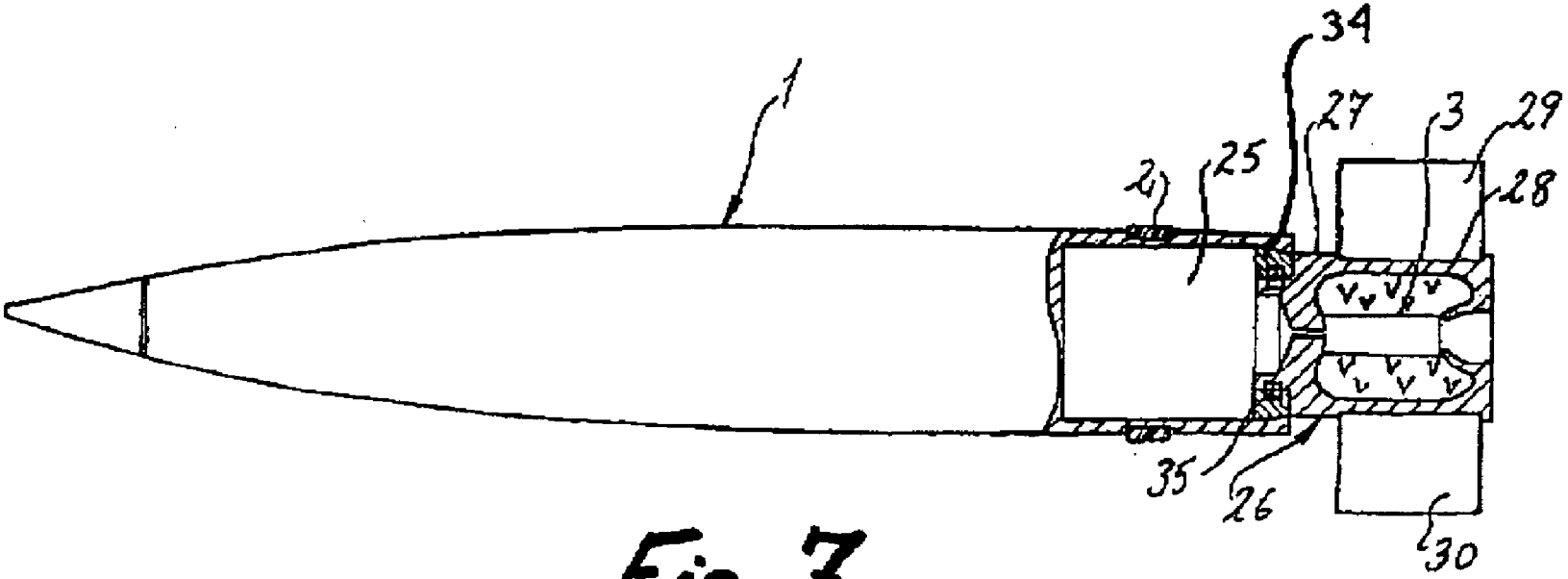
Figure 8:
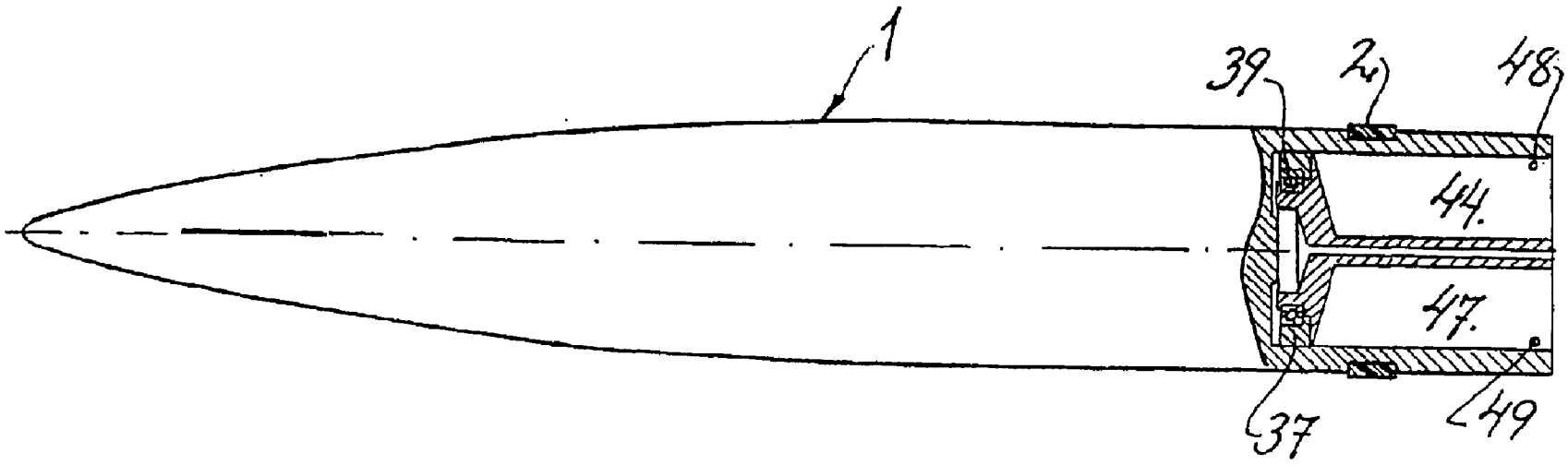
Figure 9:
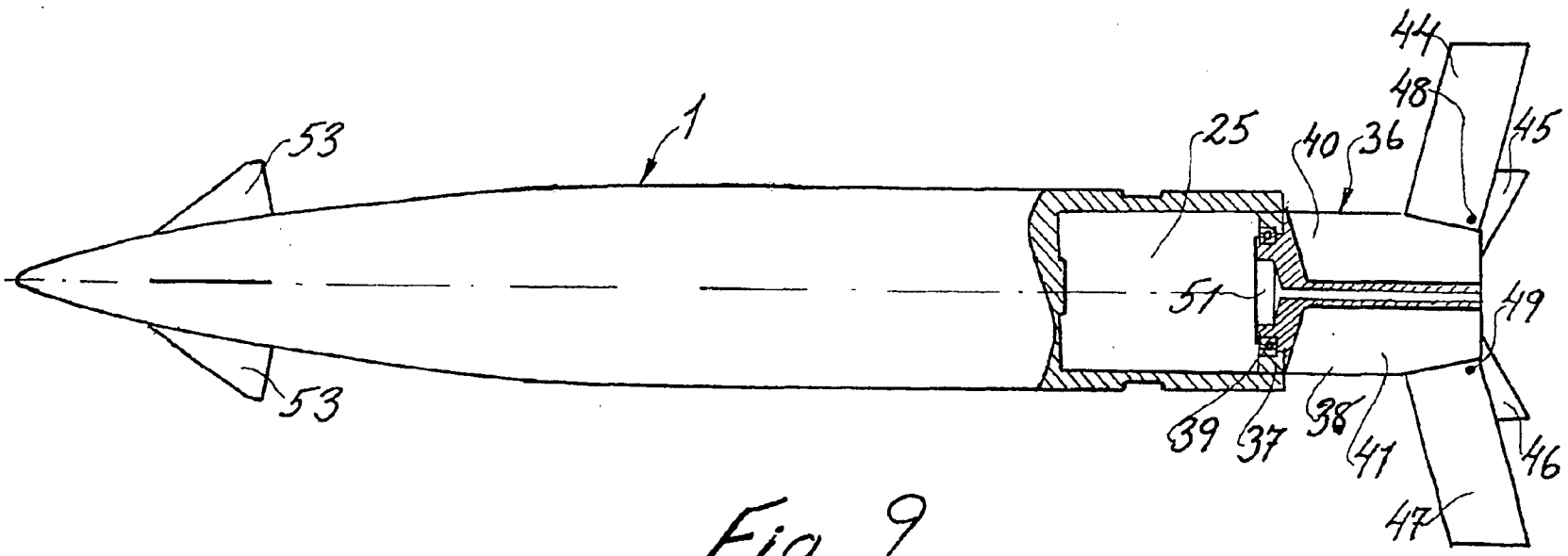
Figure 10:
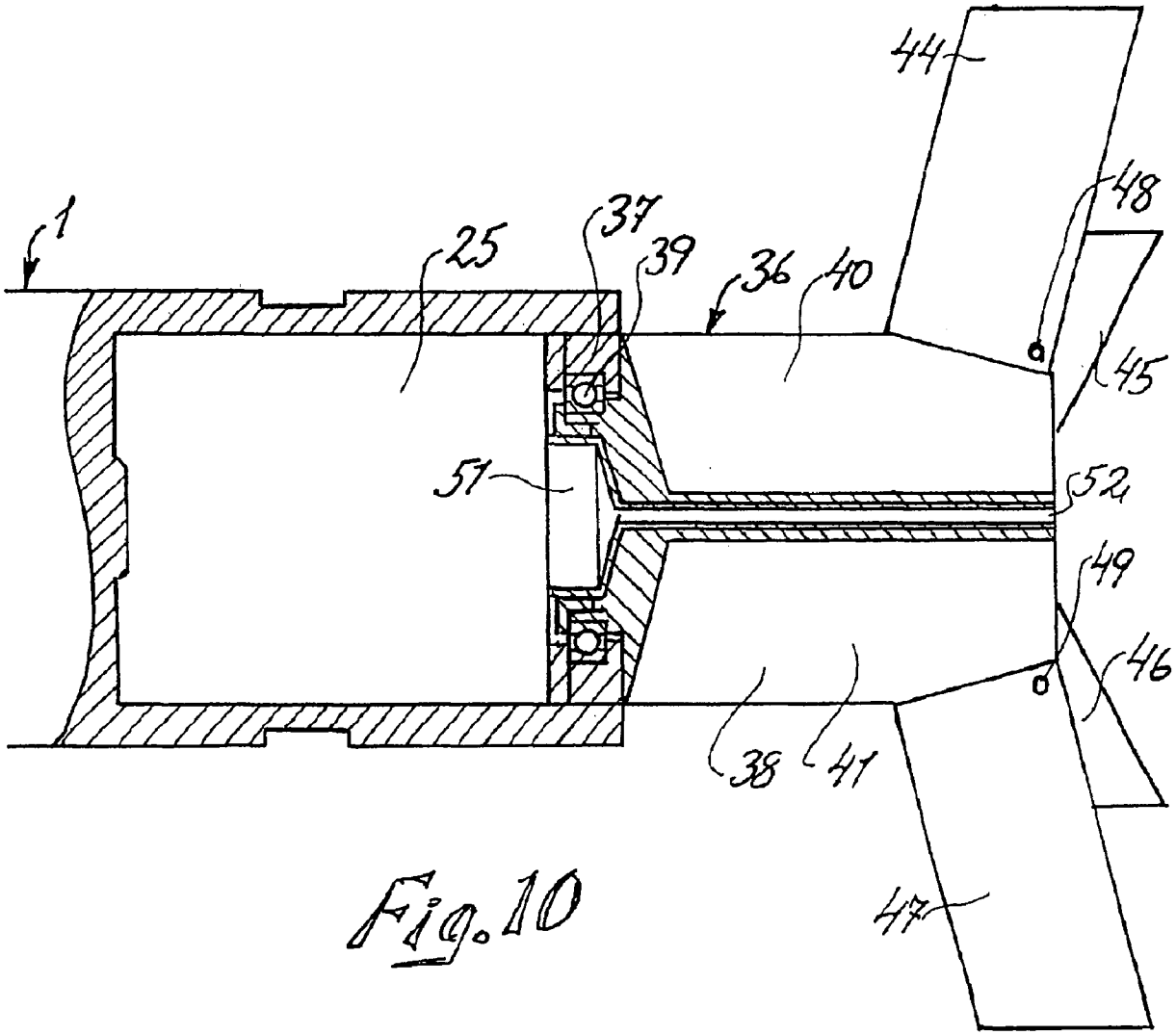

As has already been mentioned, the invention has been defined in its entirety in the attached patent claims, and the following is only a fairly detailed description made with reference to the attached figures, where:

FIG. 1 is a partial cross-sectional view showing a shell of a first type in the launch position, FIG. 2 is the same partial cross-sectional view showing the same shell after fin deployment, FIG. 3 shows the shell from FIG. 2 on a smaller scale and in an oblique projection, FIG. 4 shows, on an extra large scale, the cross-sectional rear portion of the shell from FIG. 2, FIG. 5 shows, on a different scale, an oblique projection of the body part included in FIGS. 1–4, FIG. 6 shows, on a large scale and in a cross-sectional view, a variant of the invention in the original position, FIG. 7 shows the complete shell according to FIG. 6 with the fins in the deployed position, FIG. 8 shows a partial cross-sectional view of a shell according to yet another variant of the invention, FIG. 9 shows the same shell as in FIG. 8, but with its fins in the deployed position, and FIG. 10 shows the rear part of the shell from FIG. 9 on a larger scale.

Where the same components appear in different figures, they have been given the same reference numbers regardless of whether they are shown on different scales.

The shell 1 shown in FIGS. 1, 2 and 3 and partially in FIG. 4 is provided with a plastic drive band 2 and a base-bleed unit which is incorporated in the rear part of the shell and is provided with a charge 4 of slow-burning powder and a gas outlet 6 arranged centrally in the rear plane 5 of the shell. Around the base-bleed unit 3, near the outer periphery of the shell, there is a tubular or annular gap 7 extending in the longitudinal direction of the shell. In this gap, a tubular body part 8 (see FIG. 5) can be axially displaced from its first position shown in FIG. 1, where it is fully retracted inside the gap, to its second position in FIGS. 2, 3 and 4, where it is deployed and its main part lies outside, i.e. to the rear of, the original rear plane 5 of the shell. The body part 8 is designed such that it is effectively locked in its outer position as soon as it has reached this position. A pyrotechnic charge arranged in the space 9 has been used to push the body part 8 out to its outer position. This has been initiated immediately after the shell has left the barrel from which it has been launched and powder gases formed have forced the body part out to its locked outer position. The powder gases have been distributed via the channels 10. As can be seen from FIG. 5, the holder part 8 is provided with a relatively wide track 11 arranged annularly about its outer periphery and the same number of axles 12–17, arranged in the longitudinal direction of the shell and extending over the track, as the shell has fins. One of the fins 18–24 (23 and 24 not shown in the figure) is secured about each of these axles and the fins are bent into the track 11 in their retracted position. This track thus has a sufficient depth to ensure that the retracted fins will have enough space there when the body part is inserted into the gap 7. As soon as the body part 8 has reached its outer position, the fins spread out under their own flexibility to their intended deployed positions.

Among the advantages of this construction that may be mentioned, it not only extends the distance between the stabilizing fins and the centre of gravity of the shell, it also gives the shell a hollow base, which gives the base-bleed unit an improved action.

FIGS. 6 and 7 now show a second variant of the invention where the main part of the shell can still be labelled 1 and its drive band can still be labelled 2. By contrast, the rear part of the shell here is not designed with a gap, but instead with a cylinder-shaped hollow or space 25 in which a complete unit 26 is arranged. The unit 26 comprises both the base-bleed unit and the necessary number of deployable fins and some further components and functions which will be described below. The base-bleed unit arranged in the unit 26 can also be labelled 3 here, and the same applies to its powder charge 4 and its gas outlet 6. By contrast, the base-bleed unit 3 here is contained in a cylindrical body 27 whose outer periphery has a peripheral outer track 28 which corresponds to the track 11 in the body part according to FIG. 5 and which has the same function as the latter, namely for attachment of the fins and for providing space for these when they are curved in against the body in question and the latter is situated in its position fully inserted in the hollow 25. The figures show only fins 29 and 30, but they can be of any chosen number. For pushing the complete arrangement 26 out to its outer position, use is made of a pyrotechnic charge 31 suitable for this purpose and initiated on command. When this is initiated, the powder gases formed will displace the unit 26 to its outer position, and the pyrotechnic charge also has a second function in that when it reaches its burnout it initiates the powder charge 4 of the base-bleed unit.

As can best be seen from FIG. 6, the space 25 is sealed off from the outside by an inwardly directed conical edge 32, and the unit 26 at the same time has an inner edge 33 which can be upset and is directed counter to said conical edge and which, when displaced towards the edge 32 at sufficient speed, will be deformed and give rise to effective locking between the unit 26 in its deployed position and the main part of the shell 1.

However, the shell shown in FIGS. 6 and 7 is also designed with a further refinement. The unit 26 is in fact divided up into a first section, which can again be labelled 27 since it is this section in which the base-bleed unit is arranged and in which the fins are secured, and a second section 34 which is the section by which the unit 26 in the deployed position is locked relative to the rest of the shell, and these two sections are joined to each other via a ball bearing 35.

This arrangement thus means that the fins in the deployed position will spin freely relative to the rest of the shell.

FIGS. 8–10 show a further variant of the invention which in this case is equipped with no base-bleed unit but with fins of a completely different type which have the advantage that they can be made longer and that in the deployed position they can be folded rearwards in the direction of flight of the shell, which fact further increases their stabilizing capacity. However, the basic idea remains that of displacing the fin-supporting body part rearwards and out from the rear plane of the shell upon launch in order in this way to increase the stabilizing length of the shell.

The shell body here is once again labelled 1 and its drive band is once again labelled 2. In the rear part of the shell body 1 there is a cylindrical hollow which can have the same shape as the hollow 25 of the shell in FIGS. 6 and 7. The hollow has therefore been given the same reference label in these figures too, i.e. 25. In said hollow 25, a body part 36 can be displaced between a first position and a second position. In its first position, the whole body part 36 lies inside the hollow 25 and in its second position most of the body part 36 lies behind the original rear plane of the shell, while still being connected to the shell. The body part 36 further comprises a front section 37 which, when it reaches its rearmost position in connection with the pushing-out of the body part from the hollow 25, is locked relative to the rest of the shell body, for example by means of an abutment joint. In addition, the body part 36 comprises a rear section 38 which is connected to its front section 37 by means of rotating ball bearing 39. The rear part 38 of the body, which in the deployed position thus comes to lie behind the original rear plane of the shell, is further provided with a number of radial tracks extending in the direction of flight of the shell, of which the tracks 40 and 41 can be seen in the figures, and in each of these tracks there is a deployable fin 42–47 (the fins 42 and 43 are not shown in the figures). Each of these fins can be deployed about its axle arranged in the rear section of the body part 38 transverse to the direction of flight of the shell. (FIG. 10 shows the axles 48 and 49 for example). When the fins are deployed, they move outwards and rearwards about their respective axles, the outer ends of the fins following an arc-shaped trajectory to a preferably slightly rearward position shown in FIGS. 9 and 10.

The body part 36 also includes a space 51 in which it is possible initially to arrange a pyrotechnic charge which generates gas when initiated and, upon initiation of this charge, the body part is driven from its inner position to its outer position. There is also a gas outlet 52 for excess powder gas.

According to a variant of the method for displacing the body part from its inner position to its outer position, an empty chamber is arranged at a suitable location between the main part of the shell and the displaceable body part. This empty chamber can thus be arranged at the same location as the chamber 51 and it will be designed in such a way that, during the shell launch phase, it communicates with the inside of the barrel via an opening of defined size. This opening can be the same as the opening 52 and it will be adapted such that the full barrel pressure prevails inside the chamber 51 when the shell leaves the barrel. When the shell leaves the barrel, the pressure outside the shell drops more or less instantaneously from the barrel pressure to normal atmospheric pressure. This very rapid reduction in pressure outside the shell, combined with a high initial pressure inside the chamber 51 in question, can then be used to force the body part 36 out from its first position to its second position. As the counterpressure on the outside disappears, the overpressure inside the chamber 51 is easily able to force the body part 36 out to its outer position. In order to function satisfactorily, this method requires a correct adaptation of the dimensions of the chamber 51 and of the connection 52 functioning as outlet and inlet.

As can be seen from FIG. 9, the shell according to this figure is also provided with deployable canard fins 53, 54 which are additionally movable so that their angle relative to the longitudinal axis of the shell can be modified within certain values, which in turn makes it relatively simple to make the shell controllable within fairly wide limits. The canard fins can additionally give the shell extra lifting force, and when a shell is equipped with canard fins it is advantageous if the distance between these and the normal stabilizing fins is as great as possible. As has already been mentioned, it is together with control functions, for example those obtained with canard fins, that the freely rotating fin portion of the shell gains its full effect since the shell is thereby more easily manoeuvred.

What is claimed is:

1. A fin-stabilized artillery shell, comprising:

a shell body;

a body part mounted in an annular space in a rear of the shell body, the body part having a plurality of stabilizing fins; and an expansion chamber between a front part of the shell and the body part where gas expansion takes place; and at least one channel connecting the expansion chamber to the annular space, wherein the body part is axially displaceable from a space in the rear of the shell body from a first position to a second outer position that extends the length of the shell rearward, the body part is tubular and fits in the annular space when the body part is in the first position, the fins are deployable when the body part is in the second outer position, and the gas expansion comes from a charge, wherein the gas expansion displaces the body part from the first position to the second position.

2. The fin-stabilized artillery shell of claim 1, wherein the body part comprises:

a track mounted in the annular space when the body part is in its first position, wherein the plurality of fins are pivotably mounted to the track by axles, wherein the annular space extends forward in the shell body to accommodate substantially the whole of the body part and the fins when the body part is in the first position.

3. The fin-stabilized artillery shell of claim 1, wherein the rear of the shell body houses a powder charge and a gas outlet for the powder charge.

4. The fin-stabilized artillery shell of claim 1, wherein the plurality of fins are pivotably mounted about a periphery of the body part.

5. The fin-stabilized artillery shell of claim 1, comprising:

a pyrotechnic charge in the expansion space.

6. The fin-stabilized artillery shell of claim 1, wherein the fins are mounted on axles arranged along a longitudinal direction of the shell and are incurved transversely and wrapped around the body part when the body part is in the first position and wherein the fins are deployable radially outward from the body part.

7. A fin-stabilized artillery shell, comprising:

a shell body;

a body part mounted in a space in a rear of the shell body, the body part having a plurality of stabilizing fins and comprising a first section and a second section rotatably connected to the first section, wherein the fins are mounted to the first section; and an expansion chamber between a front part of the shell and the body part where gas expansion takes place, wherein the body part is axially displaceable from a space in the rear of the shell body from a first position to a second outer position that extends the length of the shell rearward, the fins are deployable when the body part is in the second outer position, the gas expansion displaces the body part from the first position to the second position, a deformable inner edge of the first section deforms and engages an edge of the second section when the body part is in the second position.

8. The fin-stabilized artillery shell of claim 7, wherein the first section is rotatably mounted to the second section by a ball bearing.

9. The fin-stabilized artillery shell of claim 7, wherein the first section houses a powder charge and a gas outlet for the powder charge.

10. The fin-stabilized artillery shell of claim 7, wherein the fins are mounted about axes of rotation extending transverse to a width direction of the fins.

11. The fin-stabilized artillery shell of claim 7, wherein the fins are folded forwards and inwards about axes of rotation in grooves extending in a longitudinal direction of the shell when the body part is in the first position, and wherein the fins execute a rotational movement of at least 90° about said axes outwards and rearwards in the direction of flight of the shell.

12. The fin-stabilized artillery shell of claim 7, comprising:

canard fins at a front part of the shell that are deployable substantially simultaneously with the deployment of the plurality of fins.

13. The fin-stabilized artillery shell of claim 7, wherein the space is cylinder-shaped and the fins are secured along the outer periphery of the body part in the space, and comprising: a base-bleed unit having a powder chamber containing a slow-burning powder, an igniter which initiates the powder, and a gas outlet arranged at a rear plane of the cylinder-shaped body part.

14. The fin-stabilized artillery shell of claim 7, wherein an axis of rotation of the first section with respect to the second section coincides with a longitudinal axis of the shell, and the first section is locked relative to the shell body when the body part is in the second position.

15. The fin-stabilized artillery shell of claim 7, wherein the plurality of fins are pivotably mounted about a periphery of the body part.

16. A fin-stabilized artillery shell, comprising:

a shell body;

a body part mounted in a space in a rear of the shell body, the body part having a plurality of stabilizing fins, a base-bleed charge located therein and a gas outlet;

an expansion chamber between a front part of the shell and the body part where gas expansion takes place; and pyrotechnic means in the expansion chamber for generating the gas expansion and initiating the base-bleed charge, wherein the body part is axially displaceable from a space in the rear of the shell body from a first position to a second outer position that extends the length of the shell rearward, the fins are deployable when the body part is in the second outer position, and the gas expansion displaces the body part from the first position to the second position before initiating the base-bleed charge.

17. The fin-stabilized artillery shell of claim 16, wherein the body part comprises a first section and a second section rotatably connected to the first section, wherein the fins are mounted to the first section.

* * * * *